US006151912A

United States Patent [19]

Rose

[11] Patent Number: 6,151,912

[45] Date of Patent: Nov. 28, 2000

[54] PORTABLE APPARATUS FOR SELECTIVELY HEATING AND COOLING AN OBJECT

[76] Inventor: Jim E. Rose, 4287-A Beltline Rd., Suite 156, Dallas, Tex. 75244

[21] Appl. No.: 09/219,251

[22] Filed: Dec. 22, 1998

[51] Int. Cl.[7] ..... F17C 13/00

[52] U.S. Cl. ..... 62/457.9; 62/239; 62/407

[58] Field of Search ..... 62/239, 407, 457.3, 62/457.9

[56] References Cited

U.S. PATENT DOCUMENTS

| | | | |
|---|---|---|---|
| 2,902,838 | 9/1959 | Nichols . | |
| 3,043,116 | 7/1962 | Fuller . | |
| 3,410,337 | 11/1968 | Priest . | |
| 3,505,830 | 4/1970 | Koerner . | |
| 3,757,851 | 9/1973 | Marble | 165/41 |
| 3,889,487 | 6/1975 | Frankfurt | 62/99 |
| 3,916,639 | 11/1975 | Atkinson | 62/239 |
| 4,653,289 | 3/1987 | Hodgetts | 62/239 |
| 4,765,151 | 8/1988 | Bessey | 62/239 |
| 4,823,554 | 4/1989 | Trachtenberg et al. | 62/3.3 |
| 5,762,129 | 6/1998 | Elliott | 165/48.1 |

*Primary Examiner*—William Doerrler
*Assistant Examiner*—Melvin Jones
*Attorney, Agent, or Firm*—Harry C. Post, III

[57] ABSTRACT

Portable apparatus for selectively heating and cooling an object. The apparatus comprises a container for enclosing the object. A conduit transports a portion of an output from an air-conditioning system that selectively heats and cools an interior of a motor vehicle. An attaching mechanism attaches the conduit to the motor vehicle and places the conduit in fluid communication with the output from the air-conditioning system. A connecting device connects the conduit to the container and places the conduit in fluid communication with an interior of the container for selectively heating and cooling the object enclosed in the container.

17 Claims, 1 Drawing Sheet

PORTABLE APPARATUS FOR SELECTIVELY HEATING AND COOLING AN OBJECT

BACKGROUND OF THE INVENTION

This invention relates to a portable apparatus for selectively heating and cooling an object and, more particularly, to a portable apparatus for selectively heating and cooling an object that is being transported in the motor vehicle.

It is common practice for hunters, explorers and geologists while on an excursion to use motor vehicles to travel in remote, hot and arid areas. The motor vehicles are commonly provided with air-conditioning to make the travel conditions comfortable. Sometimes, the conditions outside the motor vehicles are so severe that the interior of the motor vehicle becomes uncomfortable or even unbearable. When this occurs, certain temperature sensitive items, such as photographic film, may be ruined. Also, in this situation, the individuals inside the vehicle require drinking fluids to ward off the undesirable effects caused by the extreme temperatures. Moreover, cooling or heating the drinking fluids will assist the individual to counter the extreme temperatures existing in the vehicle.

Accordingly, it is an object of the present invention to provide portable apparatus for selectively heating and cooling an object by using the air-conditioning system of a motor vehicle.

BRIEF SUMMARY OF THE INVENTION

In accordance with the present invention, there is provided portable apparatus for selectively heating and cooling an object. The apparatus comprises a container for enclosing the object. A conduit transports a portion of an output from an air-conditioning system that selectively heats and cools an interior of a motor vehicle. An attaching mechanism attaches the conduit to the motor vehicle and places the conduit in fluid communication with the output from the air-conditioning system. A connecting device connects the conduit to the container and places the conduit in fluid communication with an interior of the container for selectively heating and cooling the object enclosed in the container.

Further, in accordance with the present invention, there is provided a portable apparatus for selectively heating and cooling an object. The portable apparatus comprises a container for enclosing the object. The container includes a top, a bottom and a plurality of sides connected to the top and the bottom for defining an interior and an exterior. An insulator is connected to the container for preventing heat transfer between the object and the exterior of the container. A conduit is used to transport a portion of an output from an air-conditioning system that is used in selectively heating and cooling an interior of a motor vehicle. The conduit includes an inlet and an outlet. An attaching mechanism attaches the conduit to a dashboard of the motor vehicle and places the conduit in fluid communication with a vent of the air-conditioning system into the interior of the motor vehicle. The attaching mechanism includes a tubular body disposed to direct the portion of the output from the vent to the inlet of said conduit. The tubular body of the attaching mechanism being in the shape of a pyramid with its apex truncated and includes a truncated end and a base having a size sufficient to circumscribe the vent. The tubular body also has four sidewalls, two of the four walls being opposed and relatively inflexible and another two walls being opposed and sufficiently flexible to permit selective movement of the relatively inflexible sidewalls toward and away from one another. The base of the tubular body is adjustable to permit movement of the opposed sidewalls in relation to various sized vents. A tubular elbow is in the attaching mechanism and has a pivotal connector rotatably connecting the truncated end of the tubular body to the tubular elbow. A fastening device is used in the attaching mechanism for fastening the base of the tubular body to the dashboard. The fastening device of the attaching mechanism is adjustable and includes a synthetic material made from complemental parts adhering to each other when pressed together. One complemental part is attached on opposed sides of the vent to the dashboard and the other complemental part is attached to two opposed sides of the base of said conduit. A first support member is connected on opposed sides of the vent to the dashboard and disposed to extend substantially transverse to the complemental parts of synthetic material. The first support member supports at least one male component extending away from the dashboard. A second support member for each first support member is connected to the base of the other two walls of said attaching mechanism. The second support member supports a plurality of female components disposed to complementary receive the male members. A connecting device connects the outlet end of the conduit to the container and places the conduit in fluid communication with the interior of the container for selectively heating and cooling the object enclosed in the container.

BRIEF DESCRIPTION OF THE SEVERAL VIEWS OF THE DRAWING

Objects and advantages of the invention will become apparent upon reading the following detailed description and upon reference to the drawings, wherein like reference characters are used throughout to designate like parts.

DETAILED DESCRIPTION OF THE INVENTION

Figure 1:
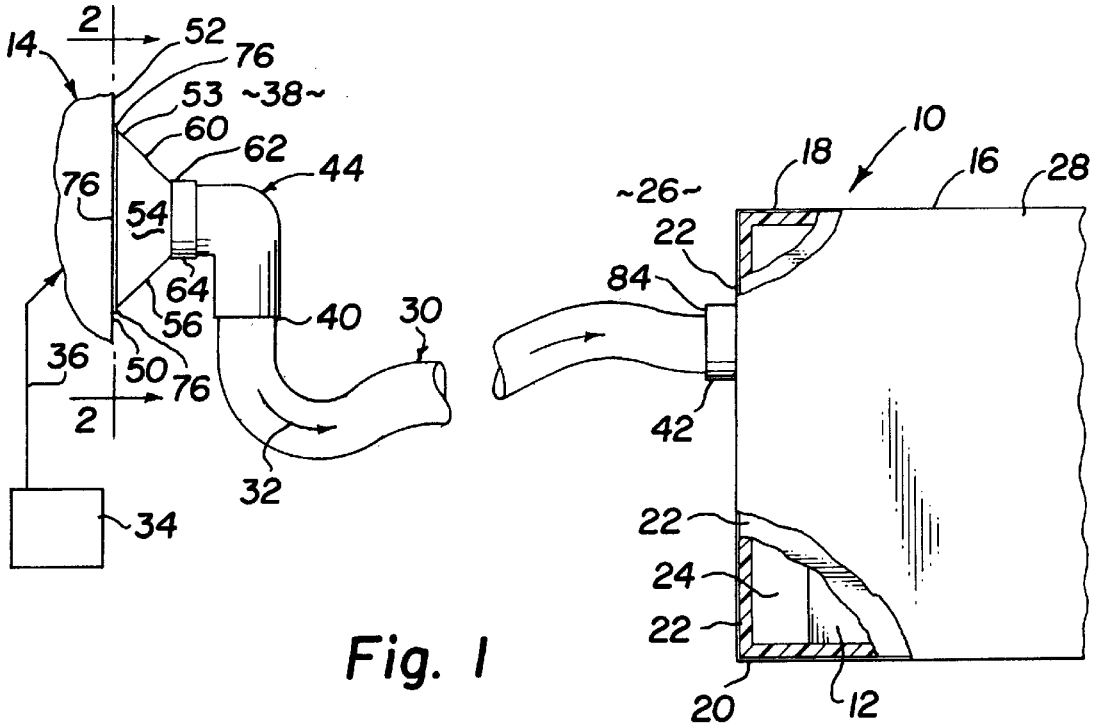
FIG. 1 is a front view, in elevation, of a portable apparatus constructed according to the present invention, a portion of the apparatus being in section.
Figure 2:
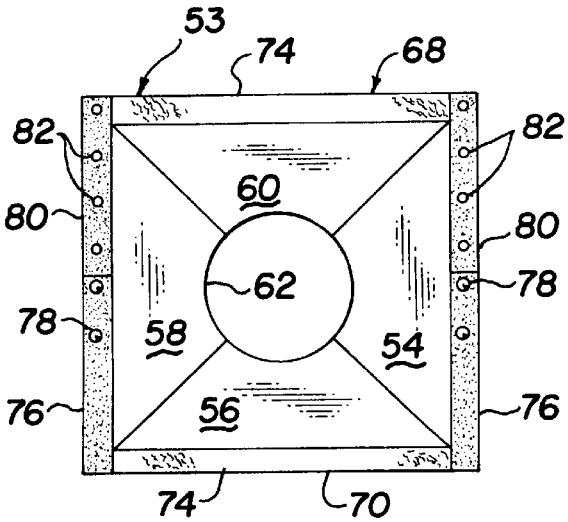
FIG. 2 is an enlarged view of the apparatus shown in FIG. 1 taken along the lines and in the direction of the arrows 2—2.
Figure 3:
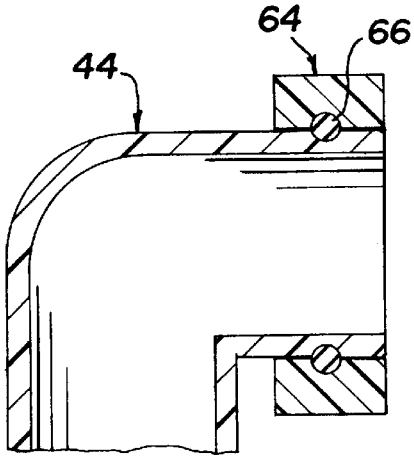
FIG. 3 is a back, enlarged sectional view of a portion of the apparatus shown in FIG. 1.

Turning now to the drawing, there is shown portable apparatus 10 for selectively heating and cooling an object 12 being transported in a motor vehicle 14.

A container 16 is provided to enclose object 12. Container 16 includes a top 18, a bottom 20 and a plurality of sidewalls 22 interconnecting top 18 and bottom 20 to one another. An interior 24 of container 16 is defined by top 18, bottom 20 and sidewalls 22, while an exterior 26 of container 16 is the environment outside of top 18, bottom 20 and sidewalls 22.

An insulator 28 is connected to container 16 for preventing heat transfer between interior 24 and exterior 26 of container 16. Although insulator 28 may be made from any conventional material, it is preferred that a cloth be used to provide the insulation with a better appearance and to assist in preventing injury should an individual inadvertently hit or be hit by container 16.

A conduit 30 is used in transporting a portion 32 of the output 34 from a conventional air-conditioning system 36, which is used in selectively heating and cooling an interior 38 of motor vehicle 14. Conduit 30 has an inlet 40 and an outlet 42. Output 34 from air-conditioning system 36 is the total air treated by system 36 flowing into interior 38 of vehicle 14.

An attaching mechanism 44 is used to attach conduit 30 to motor vehicle 14 and to place the interior of conduit 30 in fluid communication with output 34 from air-conditioning system 36.

Attaching mechanism 44 includes a tubular elbow 46 and a tubular body 48. Body 48 is disposed to direct portion 32 of output 34 from a conventional vent 50 provided in dashboard 52 of vehicle 14 into inlet 40 of conduit 30. Vent 50 receives portion 32 of output 36 from air-conditioning system 36 and is chosen from one of several vents that are provided in dashboard 52 of vehicle 14. Each vent is disposed in fluid communication with air-conditioning system 36 so that the portions passing through all of the vents provide the total output that passes into interior 38 of vehicle 14.

Tubular body 48 of attaching mechanism 44 is in the shape of a pyramid with its apex truncated. Body 48 has a base 53, four sidewalls 54, 56, 58 and 60, and truncated top or end 62.

Base 53 has a size sufficient to circumscribe vent 50 so that the entire portion 32 of output 36 passing through vent 50 is directed through body 48 into inlet 40 of conduit 30.

Sidewalls 54 and 58 oppose one another and are relatively flexible, such as being made from a canvas material, while sidewalls 56 and 60 oppose one another and are relatively inflexible, such as being made from a plastic material. Sidewalls 54 and 58 are sufficiently flexible to permit movement of sidewalls 56 and 60 toward and away from one another.

To permit adjustment of base 53 for vents having various sizes, base 53 is adjustable to permit movement of sidewalls 56 and 60 toward and away from one another.

Truncated end 62 of body 48 is rotatably connected to tubular elbow 46 by a pivotal connector 64 having an O-ring 66 pivotal connection.

A fastening device 66 is used to fasten base 53 of tubular body 48 to dashboard 52 of motor vehicle 14. Fastening device 66 of attaching mechanism 44 is adjustable and includes a first synthetic material 68 and a second synthetic material 70 disposed on each opposed side of vent 50. Synthetic material 68 and 70 are made from complemental parts 72 and 74 adhering to each other when pressed together, such as the hook and loop complemental parts in a Velcro fastener. One complemental part, such as part 72, is attached on opposed sides 68 and 70 of vent 50 to dashboard 52 of motor vehicle 14, while the other complemental part, such as part 74, is attached to opposed sides 68 and 70 of base 53 of conduit 30. Also, a first support member 76 is connected on opposed sides 78 and 80 of vent 50 to dashboard 52 and disposed substantially transverse to complemental parts 72 and 74 of synthetic material 68 and 70 and has at least one male component 78 extending away from dashboard 52. A second support member 80 for each first support member 76 is connected to base 53 of the sidewalls 54 and 56 of attaching mechanism 44. A plurality of female components 82 are provided on second support member 80 and are disposed to complementary receive male members 78.

A connecting device 84 connects outlet end 42 of conduit 30 to container 16 and places conduit 30 in fluid communication with interior 24 of container 16 for selectively heating and cooling object 12 enclosed in container 16.

In operation, an individual selects a vent 50 in motor vehicle 14 and attaches first component part 72 to opposite sides of the vent. Opposed sidewalls 56 and 60 are moved toward and away from one another to insure the entire output from vent 50 will pass through tubular body 48. After sidewalls 56 and 60 are positioned, first and second support members 76 and 80 are correctly positioned and male members 78 are inserted in female members 82. Base 53 is then attached to dashboard 52 by securing second component part 74 on base 53 to first component part 72 on dashboard 52. Elbow 44 is rotated to the position chosen by the user and inlet end 40 of conduit 30 is secured to the outlet end of elbow 44. That portion 32 of the output from air-conditioning system 36 is then directed through conduit 30 into container 16 so that object 12 may be selectively cooled or heated as determined by the user of the motor vehicle 14 through his use of the conventional air-conditioning control switches.

The invention having been described, what is claimed is:

1. Portable apparatus for selectively heating and cooling an object, comprising: a container for enclosing the object; a conduit for transporting a portion of an output from an air-conditioning system that selectively heats and cools an interior of a motor vehicle; an attaching mechanism attaching said conduit to the motor vehicle and placing said conduit in fluid communication with the output from the air-conditioning system, said attaching mechanism including a tubular body, the tubular body having a base, the base being adjustable to permit an adjustment of size in relation to a different sized vent of the air-conditioning system; and a connecting device connecting said conduit to said container and placing said conduit in fluid communication with an interior of said container for selectively heating and cooling the object enclosed in said container.

2. The portable apparatus set forth in claim 1, further comprising: said enclosing container including a top, a bottom and a plurality of sides connecting the top and the bottom to one another.

3. The portable apparatus set forth in claim 1, further comprising: an insulator connected to said container for preventing heat transfer between the container and an environment outside the container.

4. Portable apparatus for selectively heating and cooling an object, comprising: a container for enclosing the object; a conduit for transporting a portion of an output from an air-conditioning system that selectively heats and cools an interior of a motor vehicle, said conduit including an inlet and an outlet; an attaching mechanism attaching said conduit to the motor vehicle and placing said conduit in fluid communication with the output from the air-conditioning system, said attaching mechanism including a tubular body disposed to direct the portion of the output from a vent disposed in fluid communication with the air-conditioning system into the inlet of said conduit and a fastening device fastening the tubular body to a dashboard of the motor vehicle, the fastening device of said attaching mechanism being adjustable, the adjustable fastening device including a first support member connected to the dashboard and supporting at least one male component extending away from the dashboard and a second support member connected to the tubular body of said attaching mechanism and supporting a plurality of female components disposed to complementary receive the male member; and a connecting device connecting said conduit to said container and placing said conduit in fluid communication with an interior of said container for selectively heating and cooling the object enclosed in said container.

5. The portable apparatus set forth in claim 4, further comprising: the tubular body of said attaching mechanism including a base having a size sufficient to circumscribe a vent of the air-conditioning system.

6. The portable apparatus set forth in claim 4, further comprising: the adjustable fastening device including a synthetic material made from complemental parts adhering to each other when pressed together, one complemental part being attached to the dashboard of the motor vehicle and the other complemental part being attached to said conduit.

7. Portable apparatus for selectively heating and cooling an object, comprising: a container for enclosing the object; a conduit for transporting a portion of an output from an air-conditioning system that selectively heats and cools an interior of a motor vehicle; an attaching mechanism attaching said conduit to the motor vehicle and placing said conduit in fluid communication with the output from the air-conditioning system, said attaching mechanism including a tubular body, a tubular elbow, and a pivotal connector rotatably connecting the tubular body to an end of the tubular elbow; and a connecting device connecting said conduit to said container and placing said conduit in fluid communication with an interior of said container for selectively heating and cooling the object enclosed in said container.

8. The portable apparatus set forth in claim 7, further comprising: the tubular body of said attaching mechanism being in the shape of a truncated pyramid having a base and a plurality of sidewalls.

9. The portable apparatus set forth in claim 8, further comprising: the base of the tubular body being adjustable to permit an adjustment of size in relation to a different sized vent of the air-conditioning system.

10. The portable apparatus set forth in claim 9, further comprising: the fastening device of said attaching mechanism being adjustable.

11. The portable apparatus set forth in claim 10, further comprising: the adjustable fastening device including a synthetic material made from complemental parts adhering to each other when pressed together, one complemental part being attached to the dashboard of the motor vehicle and the other complemental part being attached to said conduit.

12. The portable apparatus set forth in claim 10, further comprising: the adjustable fastening device including a first support member connected to the dashboard and supporting at least one male component extending away from the dashboard and a second support member connected to the tubular body of said attaching mechanism and supporting a plurality of female components disposed to complementary receive the male member of the first support members.

13. The portable apparatus set forth in claim 9, further comprising: two opposed walls of the plurality of sidewalls being relatively inflexible and another two opposed walls of the plurality of side wills being flexible to permit selective movement of the relatively inflexible sidewalls toward and away from one another.

14. The portable apparatus set forth in claim 13, further comprising: the fastening device of said attaching mechanism being adjustable.

15. The portable apparatus set forth in claim 14, further comprising: the adjustable fastening device including a synthetic material made from complemental parts adhering to each other when pressed together, one complemental part being attached on opposed sides of the vent to the dashboard of the motor vehicle and the other complemental part being attached to opposed sides of the base of said conduit.

16. The portable apparatus set forth in claim 14, further comprising: the adjustable fastening device including a first support member connected on opposed sides of the vent to the dashboard and supporting at least one male component extending away from the dashboard and a second support member for each first support member connected to the tubular body of said attaching mechanism and supporting a plurality of female components disposed to complementary receive the male member.

17. Portable apparatus for selectively heating and cooling an object, comprising: a container for enclosing the object; said container including a top, a bottom and a plurality of sides connected to the top and the bottom for defining an interior and an exterior; an insulator connected to said container for preventing heat transfer between the object and the exterior of the container; a conduit for transporting a portion of an output from an air-conditioning system used in selectively heating and cooling an interior of a motor vehicle, said conduit including an inlet and an outlet; an attaching mechanism for attaching said conduit to a dashboard of the motor vehicle and placing said conduit in fluid communication with a vent of the air-conditioning system into the interior of the motor vehicle, said attaching mechanism including a tubular body disposed to direct the portion of the output from the vent to the inlet of said conduit, the tubular body of said attaching mechanism being in the shape of a pyramid with its apex truncated and including a truncated end, a base having a size sufficient to circumscribe the vent, four sidewalls, two of the four walls being opposed and relatively inflexible and another two walls being opposed and sufficiently flexible to permit, selective movement of the relatively inflexible sidewalls toward and away from one another, the base of the tubular body being adjustable to permit movement of the opposed sidewalls in relation to various sized vents, a tubular elbow, a pivotal connector rotatably connecting the truncated end of the tubular body to the tubular elbow, and a fastening device fastening the base of the tubular body to the dashboard, the fastening device of said attaching mechanism being adjustable, the adjustable fastening device including a synthetic material made from complemental parts adhering to each other when pressed together, one complemental part being attached on opposed sides of the vent to the dashboard and the other complemental part being attached to two opposed sides of the base of said conduit, and a first support member connected on opposed sides of the vent to the dashboard and disposed to extend substantially transverse to the complemental parts of synthetic material, the first support member supporting at least one male component extending away from the dashboard and a second support member for each first support member connected to the base of the other two walls of said attaching mechanism, the second support member supporting a plurality of female components disposed to complementary receive the male members; and a connecting device connecting the outlet end of said conduit to said container and placing said conduit in fluid communication with the interior of said container for selectively heating and cooling the object enclosed in said container.

* * * * *